US005499805A

United States Patent [19]

Anma

[11] Patent Number: 5,499,805

[45] Date of Patent: Mar. 19, 1996

[54] PAPER SHEET STORING APPARATUS

[75] Inventor: Hideyuki Anma, Yokohama, Japan

[73] Assignee: Kabushiki Kaisha Toshiba, Kawasaki, Japan

[21] Appl. No.: 266,374

[22] Filed: Jun. 27, 1994

[30] Foreign Application Priority Data

Jun. 28, 1993 [JP] Japan ..... 5-156452

[51] Int. Cl.[6] ..... B65H 5/22

[52] U.S. Cl. ..... 271/3.05; 271/3.13; 271/165

[58] Field of Search ..... 414/788.8; 271/3.01, 271/3.05, 3.13, 165, 145, 154, 155

[56] References Cited

U.S. PATENT DOCUMENTS 4,465,192 8/1984 Ohba et al. ..... 271/3.05

FOREIGN PATENT DOCUMENTS 62-88731 4/1987 Japan ..... 271/3.05

62-130931 6/1987 Japan ..... 271/3.05

04089772 3/1992 Japan ..... 271/3.05

04125237 4/1992 Japan ..... 271/3.05

*Primary Examiner*—H. Grant Skaggs

*Attorney, Agent, or Firm*—Cushman Darby & Cushman

[57] ABSTRACT

A paper sheet storing apparatus includes a stacking section for storing paper sheets in a stack in a predetermined direction. In the stacking section are provided a movable shutter for receiving and supporting paper sheets which are taken in the stacking section through an inlet port, and a movable press plate for pressing paper sheets toward an outlet port. The shutter is moved towards the outlet port as paper sheets are stacked on the shutter, and the press plate is moved towards the inlet port as paper sheets are stacked under the press plate. When the shutter and the press plate approach each other by a predetermined distance as they move, the approach state is detected by a sensor. The detection signal from the sensor is input a controller, where it is determined that the stacking section is full of paper sheets.

7 Claims, 16 Drawing Sheets

PAPER SHEET STORING APPARATUS

BACKGROUND OF THE INVENTION

1. Field of the Invention

The present invention relates to a paper sheet storing apparatus applied as, for example, a banknote storage safe in an automatic teller machine.

2. Description of the Related Art

Conventionally, as disclosed in U.S. Pat. No. 5,021,639, e.g., there is known a circulation type banknote storage safe of a so-called first-in last-out type, in which banknotes received in the safe upon deposit are used as banknotes for dispensing upon withdrawal.

The paper storage safe includes a main body for storing banknotes and a banknote pressing plate. Banknotes loaded in the main body from the upper portion thereof are stacked one on another on the pressing plate, and as the number of stored banknotes increases, the pressing plate is accordingly moved downward. Upon withdrawal, the banknotes are pressed by the pressing plate against feed rollers provided in the upper portion of the main body, and separated and unloaded one by one by the feed rollers.

In the banknote storage safe having a structure in which banknotes are stacked on the banknote pressing plate, it is possible to detect the fullness state of the storage safe by checking the position of the banknote pressing plate depending on detection signal from a full detection sensor. More specifically, when the sensor detects that the banknote pressing plate has been moved down to the bottom of the main body, the sensor identifies the storage safe as being full.

Recently, as disclosed in U.S. Pat. No. 5,247,159, e.g., there is proposed a first-in last-out type banknote storage safe capable of receiving and dispensing banknotes at the same time, in which banknotes are loaded into the safe from the upper portion one by one and stacked therein, and the stacked banknotes are taken out from the lower portion of the safe. However, in the storage safe of this type, the fullness state of the storage safe cannot be detected by the above-described method.

More specifically, the storage safe of this type includes ascendable/descendable shutter and pressing board which are arranged adjacent to each other in the up-and-down direction in the main body. With this structure, banknotes loaded in the safe from the top portion is placed on the upper surface of the shutter, and banknotes for dispensing are set on the lower surface side of the pressing board, and dispensed from the bottom portion of the safe. Thus, banknotes are present on both the upper side of the shutter and lower side of the pressing board, at the same time.

Therefore, it is not possible to identify the fullness state of the banknote storage safe simply by detecting the position of each of the shutter and the pressing board.

SUMMARY OF THE INVENTION

The present invention has been contrived in consideration of the above circumstances, and its object is to provide a sheet storing apparatus which can accurately detect the fullness state of paper sheets, as well as the empty state, regardless of that the device is of the first-in last-out type capable of carrying out the receiving/dispensing at the same time.

In order to achieve the above object, there is provided, according to the present invention, a paper sheet storing apparatus comprising: a main body including a stacking Section for storing paper sheets in a stack in a predetermined direction, the main body having a paper sheet inlet port arranged at a first end portion of the main body, and a paper sheet outlet port arranged at a second end portion of the main body; conveying means provided at the main body, for taking paper sheets into the stacking section through the inlet port; receiving means arranged in the stacking section to be movable in the predetermined direction, for receiving and supporting the paper sheets taken into the stacking section through the inlet port, in a stack; drive means for moving the receiving means toward the second end portion as the paper sheets are stacked, and for transferring the paper sheets on the receiving means to the second end portion after stacking; take-out means for taking out the paper sheets stacked in the second end portion through the outlet port; pressing means arranged in the stacking section to be movable in the predetermined direction, for pressing the paper sheets stacked in the second end portion against the take-out means; detecting means for detecting an approach state when the receiving means and the pressing means approach each other by a predetermined distance; and determining means for determining that the stacking section is in a full state with the paper sheets when the detecting means detects the approach state.

With the apparatus having the above structure, the receiving means moves towards the second end portion of the main body as paper sheets are stacked on the receiving means, and the pressing means moves towards the first end portion of the main body as paper sheets are stacked in the second end portion of the main body. When the receiving means and the pressing means approach each other by a predetermined distance as they move, the approach state is detected by the detecting means. The detection signal is input the determining means, where it is determined that the main body is full of paper sheets.

There is further provided a paper sheet storing apparatus comprising: first detecting means for detecting the receiving means when the receiving means moves to a first end position close to the first end portion; second detecting means for detecting the receiving means when the pressing means moves to a second end position close to the second end portion; determining means for determining that the stacking portion is in a empty state when the first and second detecting means detect the receiving means and the pressing means at the same time.

With the storing apparatus having the above structure, the position of the receiving means is detected by the first detecting means when the receiving means is moved close to the first end portion of the main body, and the position of the pressing means is detected by the second detecting means when the pressing means is moved close to the second end portion of the main body. When the positions of the receiving means and the pressing means are detected by the first and second detecting means at the same time, it is determined by the determining means that the main body is in a near-end state.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention and, together with the general description given above and the detailed description of the preferred embodiment given below, serve to explain the principles of the invention.

FIGS. 1 to 17 show an automatic teller machine having a storage apparatus according to an embodiment of the present invention, in which:

FIG. 1 is a perspective view of the machine;

FIG. 2 is a sectional view schematically showing an upper unit structure of the machine;

FIG. 3 is a sectional view schematically showing a lower unit structure of the machine;

FIG. 4 is a longitudinal sectional view of a sheet storage safe serving as the storage apparatus;

FIG. 5 is a cross sectional view of the storage safe;

FIG. 6 is a block diagram schematically showing various sensors and the drive mechanism of the storage safe;

FIGS. 7 to 13 are longitudinal sectional views schematically illustrating the steps involved in storing paper sheets in the safe;

FIG. 14 is a longitudinal sectional view schematically illustrating a full state of the storage safe;

FIG. 15 is a flowchart designed to explain a method of detecting full and empty states of the storage safe;

FIG. 16 is a longitudinal sectional view schematically illustrating another full state of the storage safe other than the state shown in FIG. 14; and FIG. 17 is a longitudinal sectional view schematically illustrating an empty state of the storage safe.

DETAILED DESCRIPTION OF THE PREFERRED EMBODIMENT

An embodiment of the present invention will now be described in detail with reference to the drawings.

Figure 1:
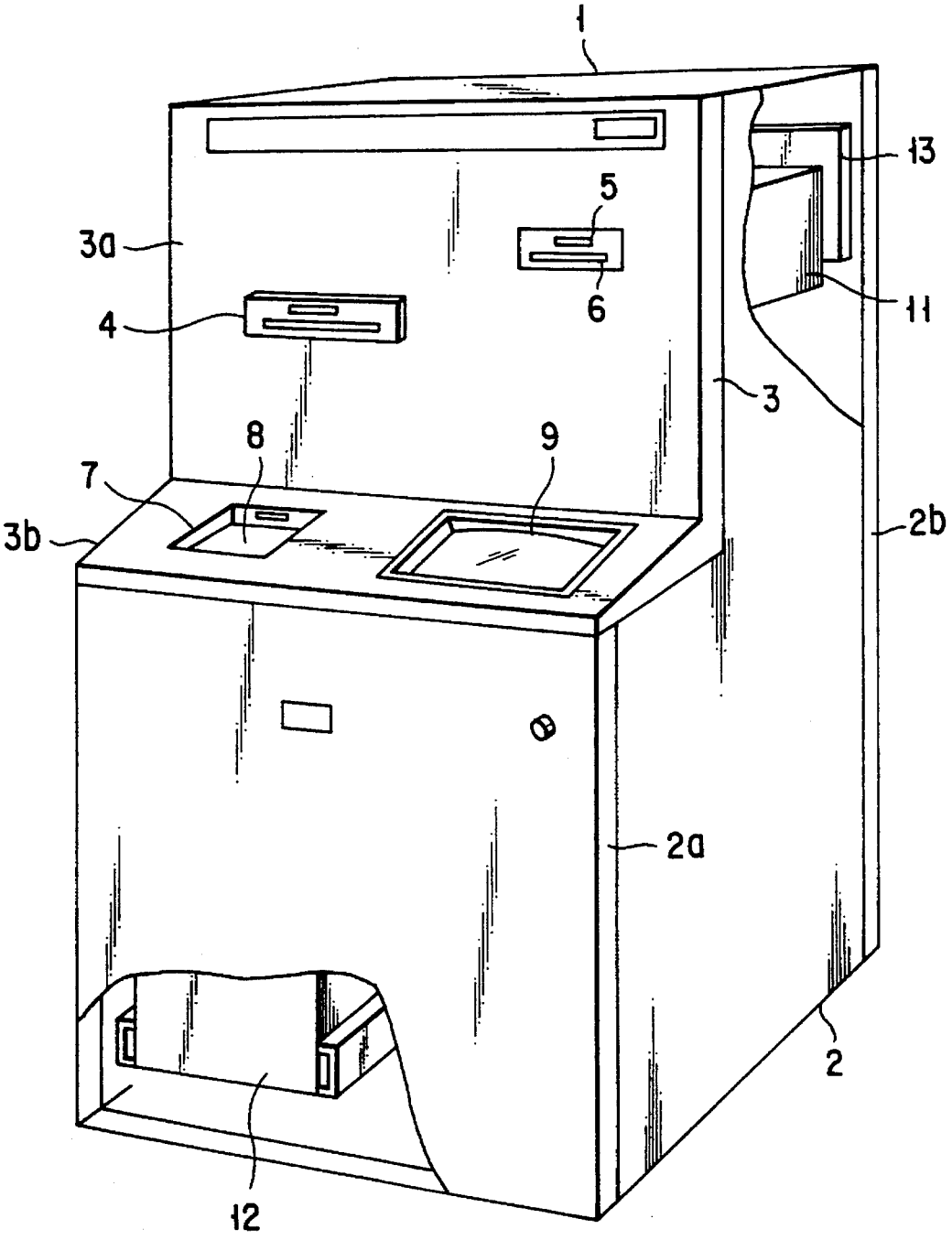

FIG. 1 is a diagram showing an automatic teller machine having a banknote storage apparatus according to the embodiment. The teller machine comprises a housing 2 having a front panel, on which a substantially L-shaped operation table 3 is provided. The operation table 3 has a vertical operation board 3*a*, on which a passbook insertion slot 4, a card insertion slot 5 and a bank statement issuing slot 6 are provided. The table 3 also has a horizontal operation board 3*b*, on which a receiving/dispensing opening 7 serving as both reception and dispensing openings is formed, and a shutter 8 for opening and closing the opening 7 is provided at the opening 7. Further, a CRT (cathode ray tube) display 9 incorporating touch sensors is provided at the horizontal operation board 3b. The CRT display 9 displays an operation sequence of the teller machine and other information by using illustration, characters and/or words and sentences, in order to prompt the user. Following the guidance provided, the user can input his/her secret identification number, an account number, an amount of banknotes, and confirmation or cancellation of transaction by touching the corresponding section thereof on the display.

The housing 2 accommodates: a passbook read/print apparatus (not shown) for reading magnetic data recorded on a passbook inserted through the passbook insertion slot 4, and printing the record and content of a transaction on the passbook; a card slip processing unit 11 for handling a magnetic card inserted through the card insertion slot 5, issuing a bank statement to the issuing slot 6, preparing a memorandum journal, etc.; a receiving/dispensing device 12 for receiving/dispensing banknotes, collecting banknotes accidentally left behind, loading and checking (counting) of banknotes; and an internal monitor 13.

Figure 2:
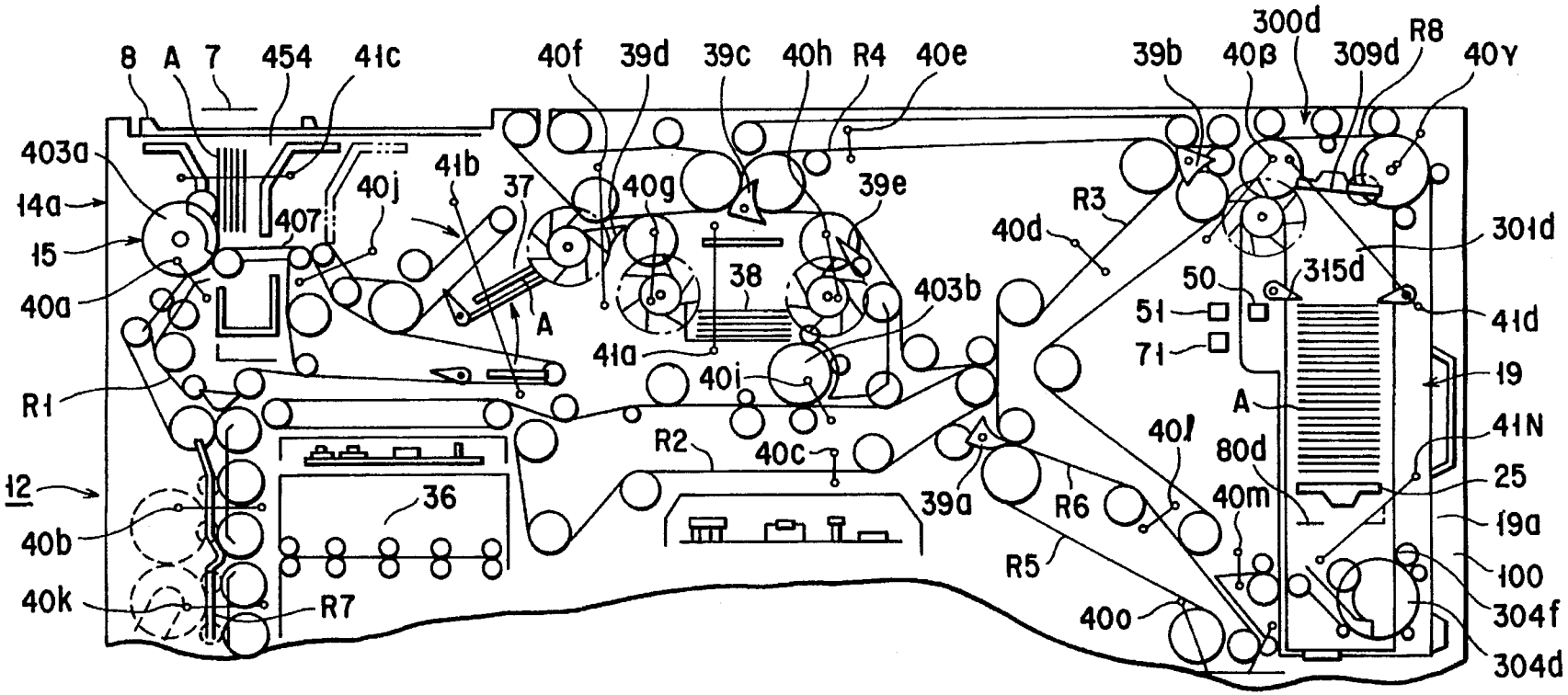
Figure 3:
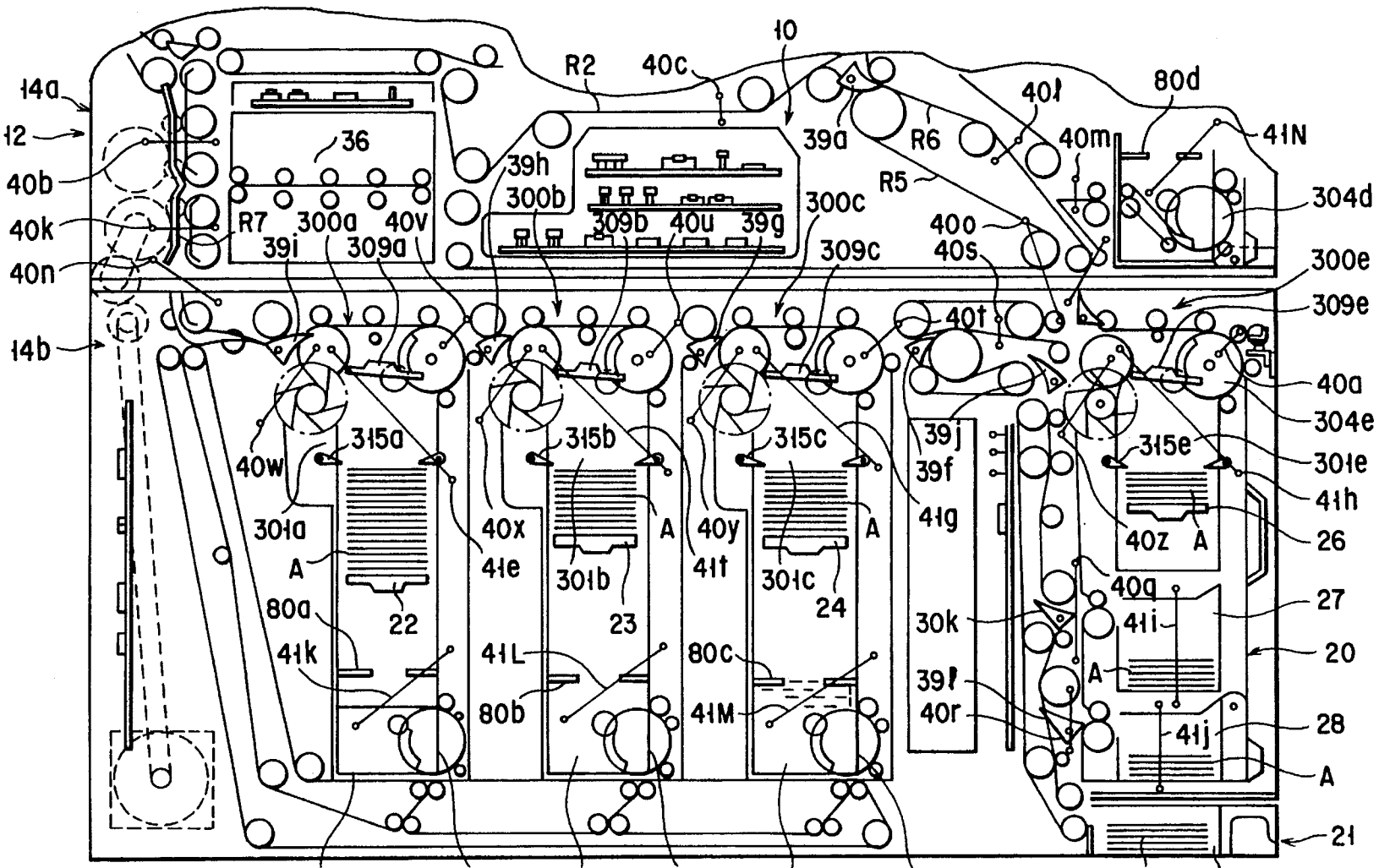

As shown in FIGS. 2 and 3, the receiving/dispensing apparatus 12 has an upper unit 14*a* and a lower unit 14*b*, and a banknote take-in/take-out unit 15 is provided in an upper front portion (directed to the customer) of the upper unit 14*a* and opposes the opening 7. A loading safe 19 serving as a block storing section, is provided in a rear portion of the upper unit 14*a*, and the safe 19 constitutes a banknote storing section for loading and storing banknotes A as paper sheets.

In the lower unit 14*b*, there are provided safes 16, 17 and 18 each serving as a storing section for storing banknotes of particular denominations, and a reception safe 20 serving as a second block storing section for storing banknotes, e.g., ¥5,000 banknote, reject banknote, or recovery banknotes inappropriate to be dispensed. Underneath the reception safe 20, there is provided a reject safe 21, which will be described later, for storing banknotes rejected during loading banknotes.

At the upper portions of the safes 16, 17 and 18, the loading safe 19 and the reception safe 20, there are respectively provided first, second, third, fourth and fifth stacking/taking devices 300*a*, 300*b*, 300*c*, 300*d* and 300*f* for loading banknotes in respective safes and taking out them therefrom. The stacking/taking devices 300*a* to 300*e* respectively have flaps 315*a* to 315*e* for defining spaces 301*a* to 301*e* as stacking sections, and press plates 309*a* to 309*e* are provided respectively in the spaces 301*a* to 301*e*. Shutters 22 to 26 each constituting a shutter mechanism, which will be described later, are arranged in the safes 16, 17 and 18, the loading safe 19 and the reception safe 20, respectively.

A mounting section 100 is provided in the rear end portion of the upper unit 14*a*, and the loading safe 19 is detachably set in the mounting section 100. A magnet 50 is built in the safe 19 so as to face a read switch 51 situated in the mounting section 100 when the safe 19 is set in the mounting section 100. The read switch 51 serves to detect the set state of the loading safe 19.

At substantially the center of the front portion in the upper unit 14*a*, an inspecting section 36 for inspecting banknotes both received and to be dispensed is arranged, and a stacking section 37 for temporary stacking the received banknotes and a stacking section 38 for temporary stacking banknotes to be dispensed are provided on the right-hand side of the inspecting section 36. Underneath the stacking sections 37 and 38, a controller 10 for controlling the operation of the receiving/dispensing apparatus 12.

In the upper and lower units 14*a* and 14*b* constituting the receiving/dispensing apparatus 12, banknote conveying paths R1 to R8 defined by a great number of conveying belts and rollers are provided, and banknotes A are conveyed to various sections via the banknote conveying paths R1 to R8. At the branching sections of these paths R1 to R8, first to thirteenth directing gates 39*a* to 39*m* are provided, and these gates are driven by rotary solenoids which are not shown. Further, at various sections in the conveying paths, detectors 40*a* to 40*z* and 40α to 40γ each for detecting the passing of a banknote are provided. At the stacking sections where banknotes A are stored, detectors (remainder check sensors) 41*a* to 41*j* are provided. Each of the detectors 40*a* to 40*z* and 40α to γ, and the detectors 41*a* to 41*j*, is made of a light-emitting element and a conventional photosensor having a light-receiving element.

The flows of a banknotes in the receiving/dispensing apparatus 12 having the above-described structure will be explained. In the deposit operation, a display portion of the CRT display 9 corresponding to a deposit is depressed by a customer. Upon this operation, the main controller of the automatic teller machine is set in the deposit standby state, and outputs a deposit instruction to the controller 10 of the receiving/dispensing apparatus 12. In response to this instruction, the controller 10 opens the shutter 8 of the receiving/dispensing opening 7.

Then, the customer places various kind of banknotes A in a banknote storage chamber 454 through the opening 7 while the obverse and reverse sides of the banknotes are not aligned. Then, the shutter 8 is closed. When closing of the shutter 8 is detected by a sensor (not shown), a floor 407 of the chamber 454 is vertically vibrated to align the banknotes A, and subsequently, a take-in roller 403*a* is rotated to sequentially receive the banknotes A one by one from the front one. The received banknotes A are conveyed along the conveying path R1, and the number of them is counted by the detector 40*a*. Further, the received banknotes A are guided to the inspecting section 36 to discriminate their denominations, authenticities, and the obverse/reverse sides.

The banknotes, which are determined that their obverse sides face upward at the inspection unit 36, are conveyed along the path R2, conveyed upward through the path R3 by the first directing gate 39*a*, and guided into the path R4 by the second directing gate 39*b*. The banknotes A passing through the path R4 are redirected by the third and fourth directing gates 39*c* and 39*d*, and are stacked in the temporary stacking section 38.

When a banknote is determined by the inspection unit 36 that its reverse side faces upward, it passes through the first and second directing gates 39*a* and 39*b*, is redirected by the third directing gate 39*c*, and is stacked upside down in the stacking section 38. In this manner, the banknotes A are stacked in the stacking section 38 such that their obverse and reverse sides are aligned.

When a banknote A is determined by the inspection unit 36 that it should be rejected (a reject banknote; a counterfeit banknote or a banknote unable to be inspected), it is sent to the temporary stacking section 37 through the first, second, third, and fourth directing gates 39*a*, 39*b*, 39*c*, and 39*d* and is stacked therein. When the banknotes A in the banknote storage chamber 454 run out, the reject banknotes A in the stacking section 37 are discharged to the storage chamber 454 in a bundle. Then, the shutter 8 is opened, and the banknote bundle is returned to the customer.

Regarding the banknotes A stacked in the banknote reception temporary stacking section 38, when the customer enters "confirm" through the CRT display 9, a take-out roller 403*b* rotates and the banknotes are then received again one by one from the lowest one. The received banknotes A are discriminated by the inspection unit 36, directed downward by the first gate 39*a*, and are conveyed to the lower unit 14*b* through the conveying path R5.

The denomination safes 16, 17, and 18 are designed to store, for example, ¥10,000 banknotes, ¥1,000 banknotes, ¥5,000 banknotes, respectively. ¥10,000 banknotes discriminated by the inspecting section 36 are horizontally conveyed through the sixth directing gate 39*f*, redirected by the seventh, eighth, and ninth directing gates 39*g*, 39*h*, and 39*i*, and stacked in the stacking section 301*a* of the ¥10,000 banknote safe 16.

¥1,000 banknotes discriminated by the inspecting section 36 are redirected by the sixth, seventh, and eighth directing gates 39*f*, 39*g*, and 39*h* and stacked in the stacking section 301*b* of the ¥1,000 banknote safe 17. Further, ¥5,000 banknotes discriminated by the inspecting section 36 are redirected by the sixth and seventh directing gates 39*f* and 39*g* and stacked in the stacking section 301*c* of the ¥5,000 banknote safe 18.

Old banknotes and reject banknotes are redirected by the sixth directing gate 39*f*, and stacked through the ninth gate 39*i* in the stacking section 301*e* of the banknote reception safe 20.

When all the banknotes A are stacked in the stacking sections 301*a*, 301*b*, and 301*e* of the safes 16, 17, 18, and 20, the banknotes A in the safes are urged downward by the press plates 309*a*, 309*b*, 309*c*, and 309*d* and locked and stacked under the flappers 315*a*, 315*b*, 315*c*, and 315*d*, respectively. A deposit operation is thus completed.

If "disapprove" is entered through the CRT display 9 while the banknotes A are stacked in the banknote reception temporary stacking section 38, the banknotes A in the section 38 are transferred to the banknote storage chamber 454 and returned to the customer as the shutter 8 is opened. When the banknotes A are removed from the storage chamber 454, the shutter 8 is closed.

Next, the flows of banknotes in the deposited banknote returning operation will be described. In a deposit operation, for example, if "cancel" is input through the CRT display 9 after banknotes A are stacked in the temporary banknote stacking section 38, the banknotes A are discarded in the storage chamber 454 at once in a bundle, and the shutter 8 is opened to return the banknotes to the customer. After the customer removes the banknotes A from the storage chamber 454, the shutter 8 is closed.

In a dispensing operation, a dispensing transaction is selected and an amount to be dispensed is input. Then, in the lower portion of the safes 16, 17, 18, and 20, the banknotes A are pressed by upper face press plates 80*a* to 80*c* against take-out rollers 304*a*, 304*b*, 304*c* and 304*e*, respectively. Thus, the banknotes A are taken out one by one by the take-out rollers.

In this case, ¥10,000 banknotes, ¥1,000 banknotes, and ¥5,000 banknotes are taken out one by one, respectively, from the safes 16, 17 and 18 and conveyed in a horizontal direction, as the take-out rollers 304*a*–304*c* are rotated. After that, these banknotes are guided in an upward direction, sent to the upper unit 14*a* through the conveying path R7, and guided to the inspecting section 36. The banknotes A, which have been determined as authentic ones by the inspecting section 36, are stacked in the temporary banknote stacking section 37 by means of the first to fourth directing gates 39*a* to 39*d*.

When a desired amount of banknotes A is stacked in the temporary banknote stacking section 37, the take-out of banknotes is stopped, and the banknotes stacked in the section 37 are discarded into the storage chamber 454 in a bundle. At the same time, the shutter 8 is opened so that the customer can withdraw the banknotes. After the banknotes A are picked up by the customer, the shutter 8 is closed. Thus, a dispensing transaction is completed.

The flow of banknotes in an operation for withdrawing the banknotes forgotten by the customer will be described. Specifically, while the shutter 8 is open, when the customer does not take out the dispensed banknotes A from the storage chamber 454 even after a lapse of a predetermined period of time, the shutter 8 is closed first. The banknotes A are received one by one from the storage chamber 454, and conveyed to a recovery box 27 or 28 of the reception safe 20 through the inspecting section 36 and the first, sixth, tenth or eleventh directing gates 39*a*, 39*f*, 39*j*, or 39*k*.

The flow of banknotes in a banknote loading (replenishment) operation which is carried out as a preparation for non-working days such as holidays will be described.

First, on a day before a holiday, a door 19*a* provided openable and detachable on the rear surface of the loading safe 19 is unlocked and pulled backward, or removed by a clerk. Then, banknotes A are set in the safe 19. After that, the door 19*a* is closed, and locked. Then, when a banknote loading mode is selected by the clerk, an automatic banknote loading operation is started.

More specifically, the banknotes A are taken out one by one by the take-out roller 304*d* of the safe 19, and conveyed via the second, third and fifth directing gates 39*b*, 39*c* and 39*e* to the inspecting section 36, where denominations of the banknotes are identified. The identified banknotes A are guided downward by the first directing gate 39*a*, and further conveyed via the eleventh directing gate 39*k* and the sixth directing gate 39*f*.

In this case, ¥1,000 banknotes which have passed the seventh directing gate 39*g* are redirected by the eighth directing gate 39*h* and stacked in the stacking section 301*b* of the safe 17 designed as a ¥1,000 safe. ¥10,000 banknotes are conveyed via the seventh directing gate 39*g*, redirected by the ninth directing gate 39*i*, and stacked in the stacking section 301*a* of the safe 16 designed as a ¥10,000 safe. ¥5,000 banknotes are conveyed via the sixth directing gate 39*f*, redirected by the seventh directing gate 39*g*, and stacked in the stacking section 301*c* of the safe 18 designed as a ¥5,000 safe.

Those of the banknotes A, which have been determined to be rejected by the inspecting section 36 during loading, are conveyed upward via the first directing gate 39*b*, and returned to the safe 19 via the second and third directing gates, or stacked in the temporary banknote stacking section 37.

Upon stacking banknotes A in the temporary banknote stacking section 37, banknotes (for loading) taken out from the safe 19 and having passed the second directing gate 39*b* may be overlapped with the rejected banknotes in the conveying path R4 between the second and third gates 38*b* and 38*c*. In order to avoid this, the taking out of banknotes is stopped instantly when a rejected banknote is generated, and after the rejected banknote has passed the conveying path R4, the taking out operation is restarted. Alternately, the taken out banknote and the rejected banknote which are overlapped with each other may be conveyed as it is, directly to the temporary stacking section 37. When there is no more banknotes A in the loading safe 19, the loading operation is completed.

In the case where rejected banknotes are generated, they are conveyed to the banknote storage chamber 454 from the stacking section 37, taken out one by one from the chamber 454 by the take-in roller 403*a*, and inspected once again by the inspecting section 36. Thereafter, the rejected banknotes identified for its denomination is guided to the lower unit 14*b* by the first directing gate 39*a*, and stored into either one of the safes 16, 17 and 18 depending on its denomination.

The banknotes once-again rejected are guided downward by the first directing gate 39*a*, and conveyed via the sixth, tenth and eleventh directing gates 39*f*, 39*i*, and 39*k*, then stacked in the recovery box 29 of the reject safe 21 by the twelfth directing gate 391.

The flow of banknotes in a checking operation will be described.

¥10,000 banknotes A taken out from the ¥10,000 safe 16 are conveyed through the path R7 to the inspecting section 36 in the upper unit 14*a*, where the banknotes are inspected. The inspected banknote A are guided into the conveying path R5 by the first directing gate 39*a*, and sent to the lower unit 14*b* to be returned to the ¥10,000 safe 16. The operation continues until a remainder detection sensor 41L detects that there is no more banknotes A underneath the shutter 22. When banknotes are rejected by the inspecting section 36 as being non-identifiable, the banknotes are conveyed via the sixth, tenth, eleventh and twelfth directing gates 39*f*, 39*j*, 39*k* and 39*l* and stacked in the recovery box 29 of the reject safe 21.

The efficiencies of the operations which handle a great number of banknotes, such as the loading or checking operation, are very important factors in an automatic apparatus of this kind.

Conventionally, upon loading banknotes in such an automatic apparatus, banknotes are stacked in units of, for example, 100, and each unit is transferred to another place successively to be stored. This storing operation is repeated until all the banknotes are loaded. In the checking operation, the number of the banknotes is counted while transferring all the banknotes from the each safe to the loading safe, and then the banknotes are returned from the loading safe to each safe. There are no other possible methods due to the structure of the conventional art. Therefore, conventionally, it requires a great amount of time in carrying out the above operations. However, according to the present embodiment, by constructing the loading safe as described later, a significant amount of time can be saved.

In this embodiment, each of the safes 16 to 18 and the loading safe 19 has a structure capable of receiving banknotes while taking out banknotes A at the same time, and capable of a successive non-stop stacking of that amount of banknotes which corresponds to the volume of the safe, in the safe. Specifically, the safes 16 to 18 and the loading 19 each serving as a banknote storing apparatus is designed to be, for example, a first-in first-out safe, and the structure thereof will be described by taking the loading safe 19 as an example.

Figure 4:
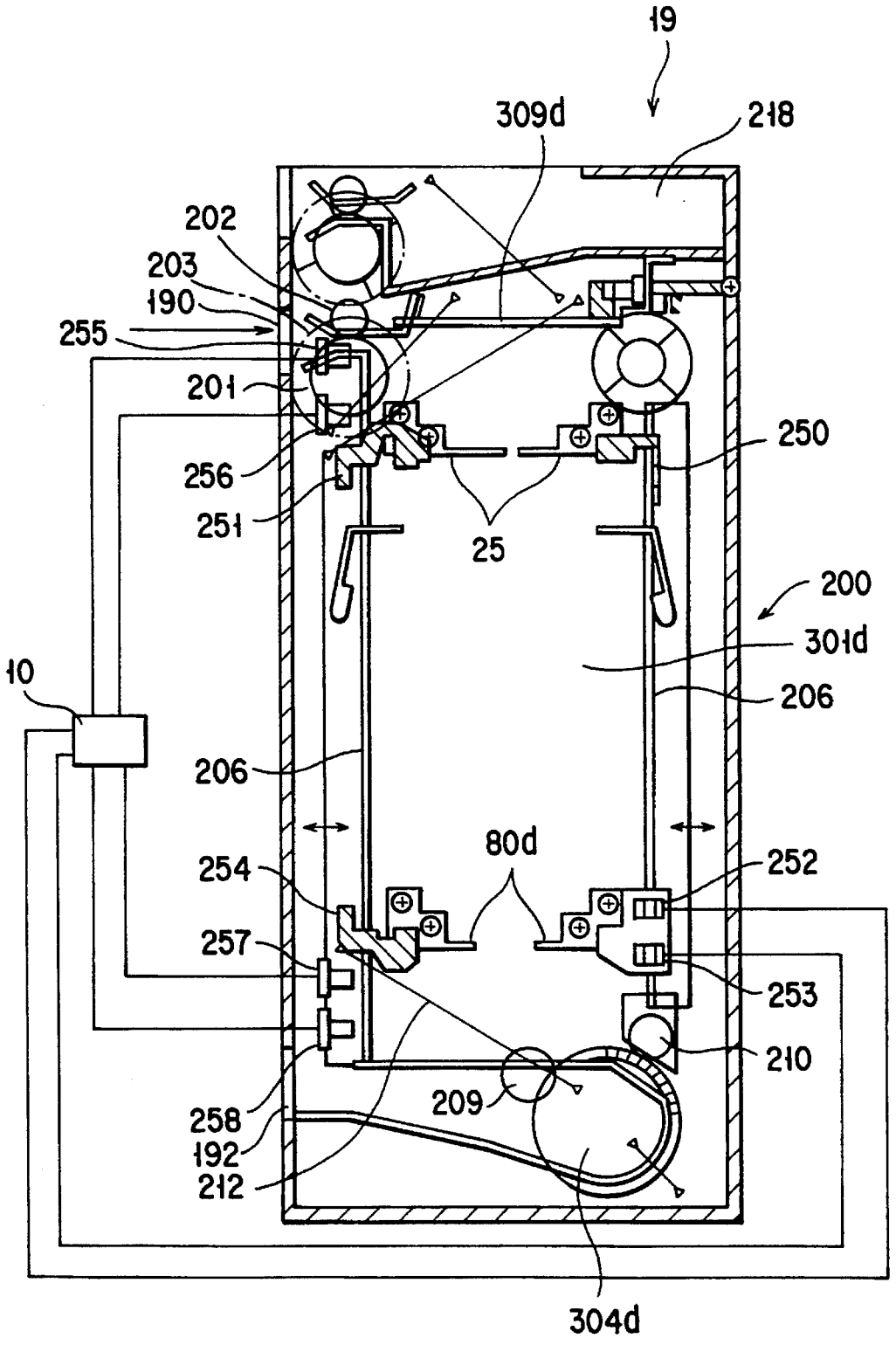
Figure 5:
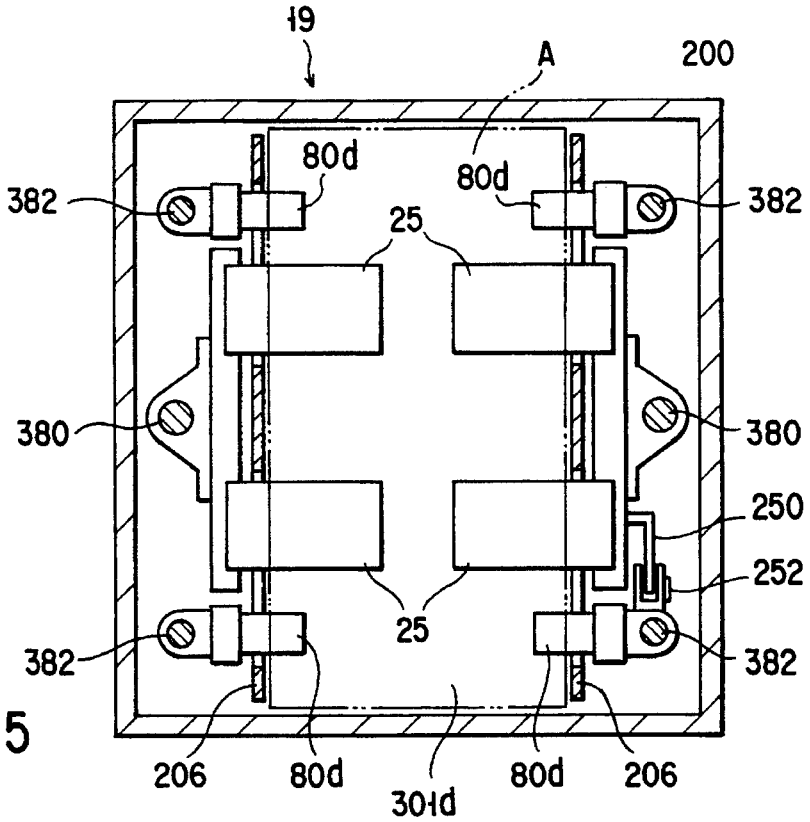
Figure 6:
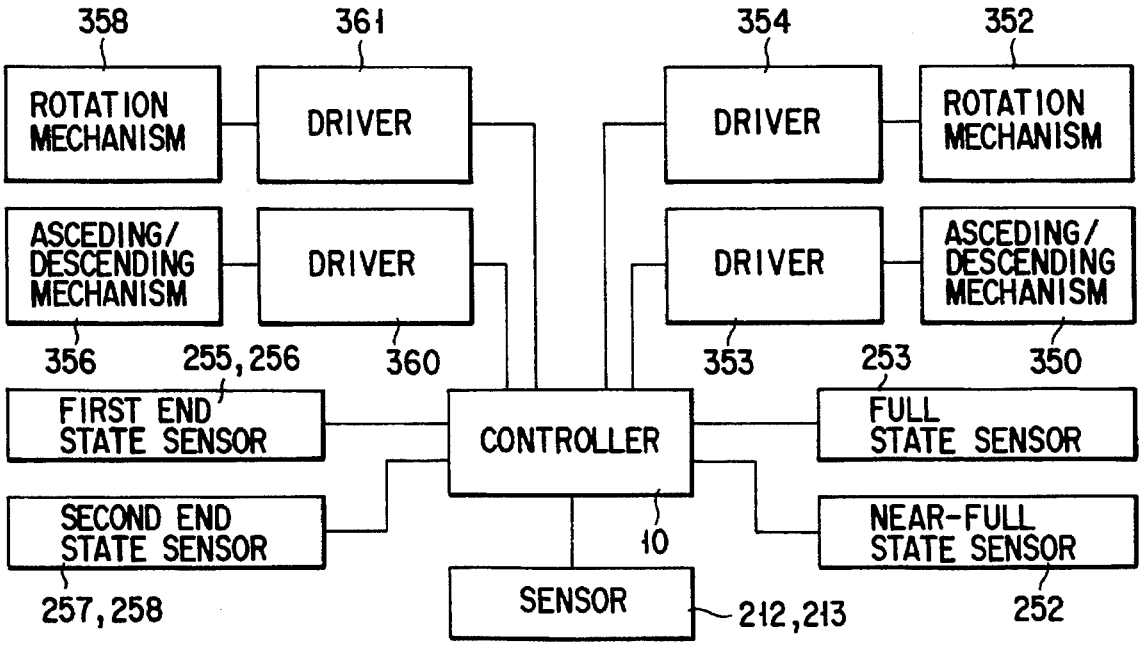

As shown in FIGS. 4 to 6, the safe 19 has a main body 200 of a rectangular shape extending in the vertical direction. In the main body 200, a pair of side walls 206 arranged in parallel with each other and extending in the vertical direction are provided, and the side walls are movable in the horizontal direction.

In the main body 200, a cone roller 201 and a pinch roller 202 are arranged on the upper end portion of one of the side walls 206 and are in rolling contact with each other. Banknotes A successively conveyed from the conveying path of the receiving/dispensing apparatus 12 are taken into the main body 200 through an inlet port 190 formed in the upper end portion of the body, sandwiched between the cone roller 201 and the pinch roller 202, and fed into the stacking section 301*d* defined between the side walls 206.

The cone roller 201 is formed to fit inside the pinch roller 202. The banknotes A are passed between the rollers 201 and 202 to has elasticity. Thus, the buckling of banknotes which is likely to occur when the banknotes are abutted to both side walls 206 during stacking the banknotes in the stacking section 301*d*, can be prevented. Coaxially fixed to the cone roller 201, is a tapping roller 203 having a plurality of flexible fans radially extending therefrom, and the tapping roller 203 is rotated in synchronous with the roller 201. The tapping roller 203 serves to press the rear end of the banknote A stacked on a pair of shutters 25 downward so as to create an entering space for the banknote A which follows.

The shutters 25 serving as receiving means are supported movably in the vertical direction by guide rods 380, and are ascended/descended synchronously by an ascending/descending mechanism 350. The shutters 25 protrude in the stacking section 301*d* and face to each other, and banknotes A taken in by the cone roller 201 and the pinch roller 202 are stacked on the shutters 25. Further, each of the shutters 25 is supported swingable in a range between a support position wherein it protrudes in the stacking section 301*d* and a retreated position for retreating from the stacking section, and is swung by a swing mechanism 352. The ascending/descending mechanism 350 and the swing mechanism 352 are connected to the controller 10 via drivers 354 and 355, respectively.

In the main body 200, four press plates 80*d* each serving as pressing means are arranged substantially at the four corners of the stacking sections 301*d* below and away from the shutter 204. The press plates 80*d* are each supported by a guide rod 382 and movable in the vertical direction, and are ascended/descended synchronously by an ascending/descending mechanism 356. The press plates 80*d* protrude in the stacking section 301*d* to face to each other, and serve to press downward the upper surfaces of stored or uncounted banknotes which are stacked in the inner bottom portion of the main body 200, thus preventing a bent or wrinkled banknote from coming up. Further, each of the press plates 80*d* is supported swingable in a range between a support position wherein it protrudes as shown in the stacking section 301*d* and a retreat position for retreating from the stacking section, and is swung by a swing mechanism 358. The ascending/descending mechanism 356 and the swing mechanism 358 are connected to the controller 10 via drivers 360 and 361, respectively.

In the bottom portion of the stacking section 301*d*, there are provided an outlet port 192, a take-out roller 304*d* for taking out banknotes stacked in the stacking section 301*d* from the bottom, a feed roller 209 rolling contact with the roller 304, and a gate roller 210. Further, a reject safe 218 for storing rejected banknotes is situated in the upper portion of the stacking section 301*d*.

A shield plate 250 for detecting a banknote-full state is attached to one of the shutters 25, and a shield plate 251 for detecting an end state is attached to the other of the shutters. First and second sensors 252 and 253 (detecting means) for detecting a banknote-full state are attached to one of the press plates 80*d* and spaced apart from each other in the moving direction of the plates. A shield plate 254 for detecting an end state is attached to the other of the press plates 80*d*. In the main body 200, a first end sensor 255 for detecting an end state by monitoring the shield plate 251 of the shutter 25 and a first near-end sensor 256 (first detecting means) are fixedly provided on the upper end side of one of the side walls 206, such as to be a predetermined distance away from each other in the moving direction of the shutter. Further, a second end sensor 257 for detecting an end state by monitoring the shield plate 254 of the press plate 205 and a second near-end sensor 258 (second detecting means) are fixedly provided on the lower end side of one of the side walls 206, such as to be a predetermined distance away from each other in the moving direction of the press plate.

These sensors 252, 253, 255, 256, 257 and 258 are connected to the controller 10 as determining means, so that detection signal is input to the controller 10. With this structure, the controller 10 determines if banknotes A in the stacking section 301*d* as being full or empty (end).

In the safe 19 having the above structure, banknotes A successively conveyed through the conveying path from the deposit/withdrawal apparatus 12 are stacked in the same order on the shutters 25 in the stacking section 301*d* by the cone roller 201 and the pinch roller 202. As banknotes are stacked, the shutters 25 are descended by the ascending/descending mechanism 350. When it is detected by the sensors 255 and 256 that the shutters 25 are located at the highest position, the controller 10 determines that there is no space sufficient for receiving banknotes in the stacking section 301*d*. Therefore, the controller 10 drives the ascending/descending mechanism 350 to descend the shutter 25 to define a space for receiving banknotes. Thus, a stable stacking of banknotes can be achieved.

Figure 7:
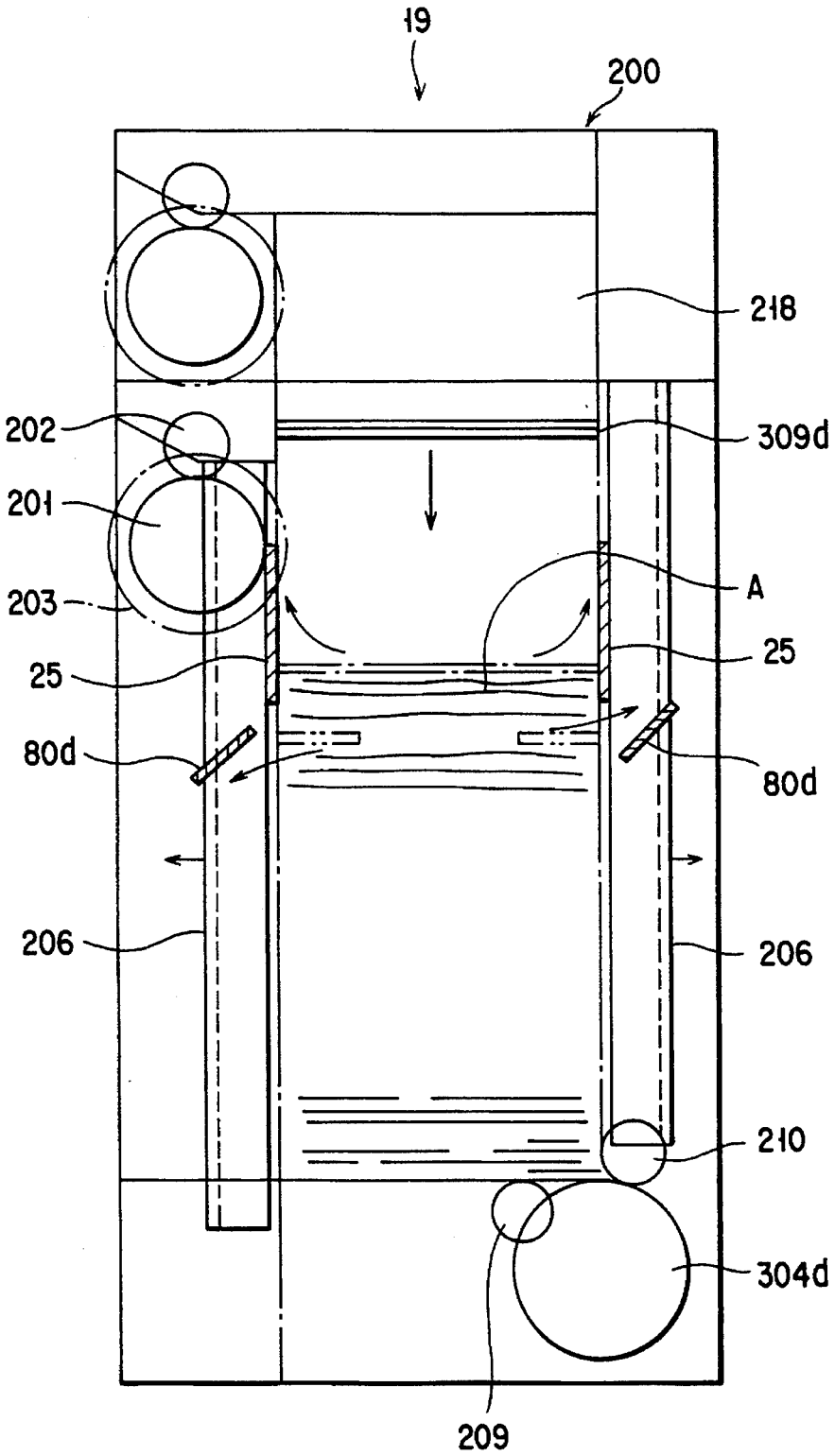

When the conveyance of the banknote A is completed, as shown in FIG. 7, the shutters 25 are descended to a lowered position, which is a certain distance away from the press plates 80*d*. At the lowered position, the shutters 25 and the press plates 80*d* are both swung to the retreat position by the swing mechanisms 352 and 358. Therefore, the banknotes stacked on the shutters 25 are dropped upon banknotes stacked underneath the press plates 80*d*. Both side walls 206 of the main body 200 are pushed outward by the shutters 25 to a measurement equal to the breadth of the shutters 25, thus facilitating the dropping of the banknotes A in the bottom.

Figure 8:
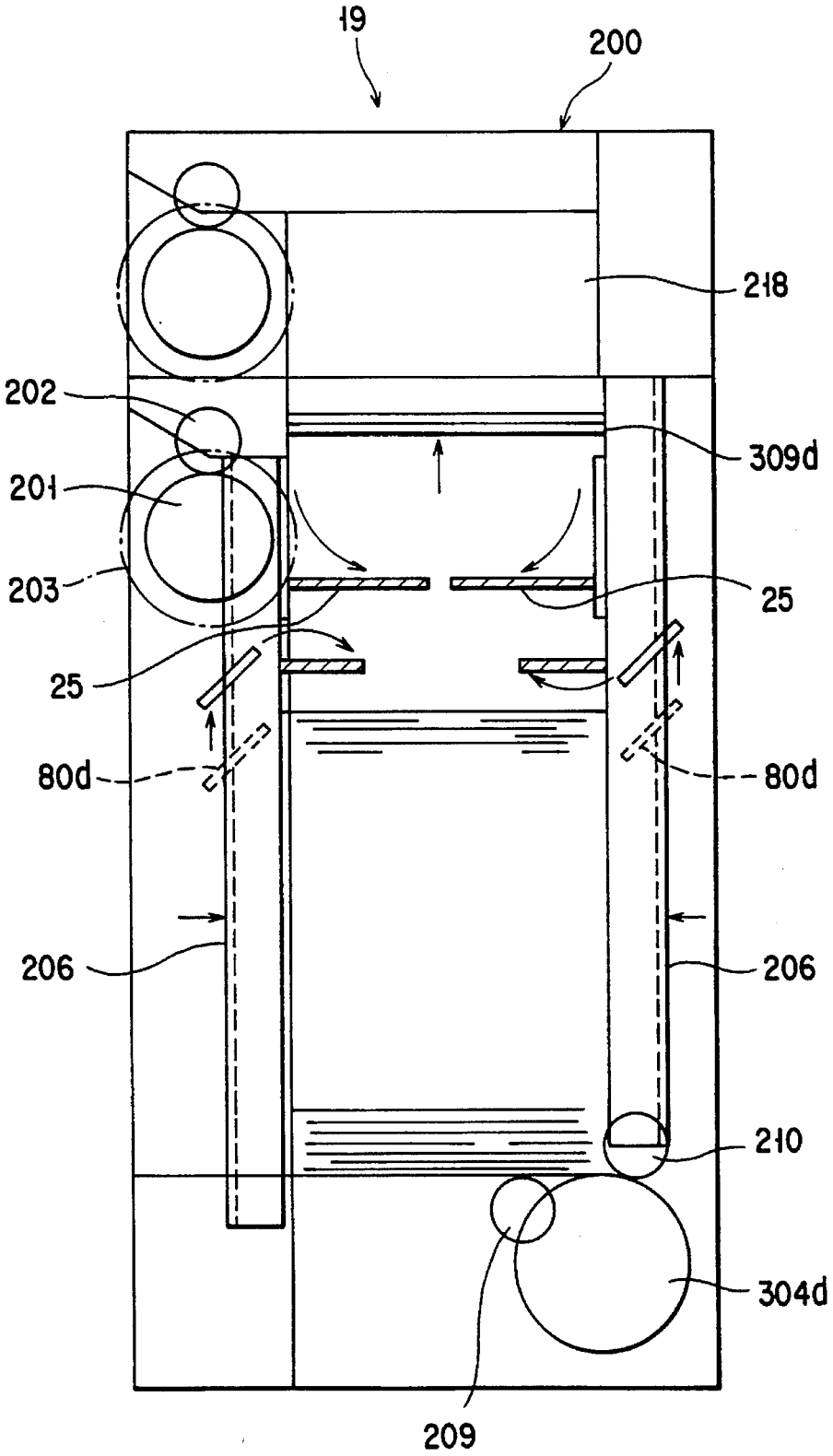

When the banknotes A stacked on the shutter 25 are dropped, a press-in plate 309d provided ascendable/descendable above the shutters 25 is descended from the upper end of the stacking section 301*d* to press the banknotes stacked below the press plates 80*d* from above. After that, as shown in FIG. 8, the press-in plate 309d is returned to the ascending position, and the shutters 25 and the press plates 80*d* are lifted to the highest position while being opened. At the highest position, the shutters 25 and the press plates 80*d* are swung to the support and press positions, respectively, to recover the original close state. At the same time, both side walls 206 of the main body 200 are returned to the original state.

Figure 9:
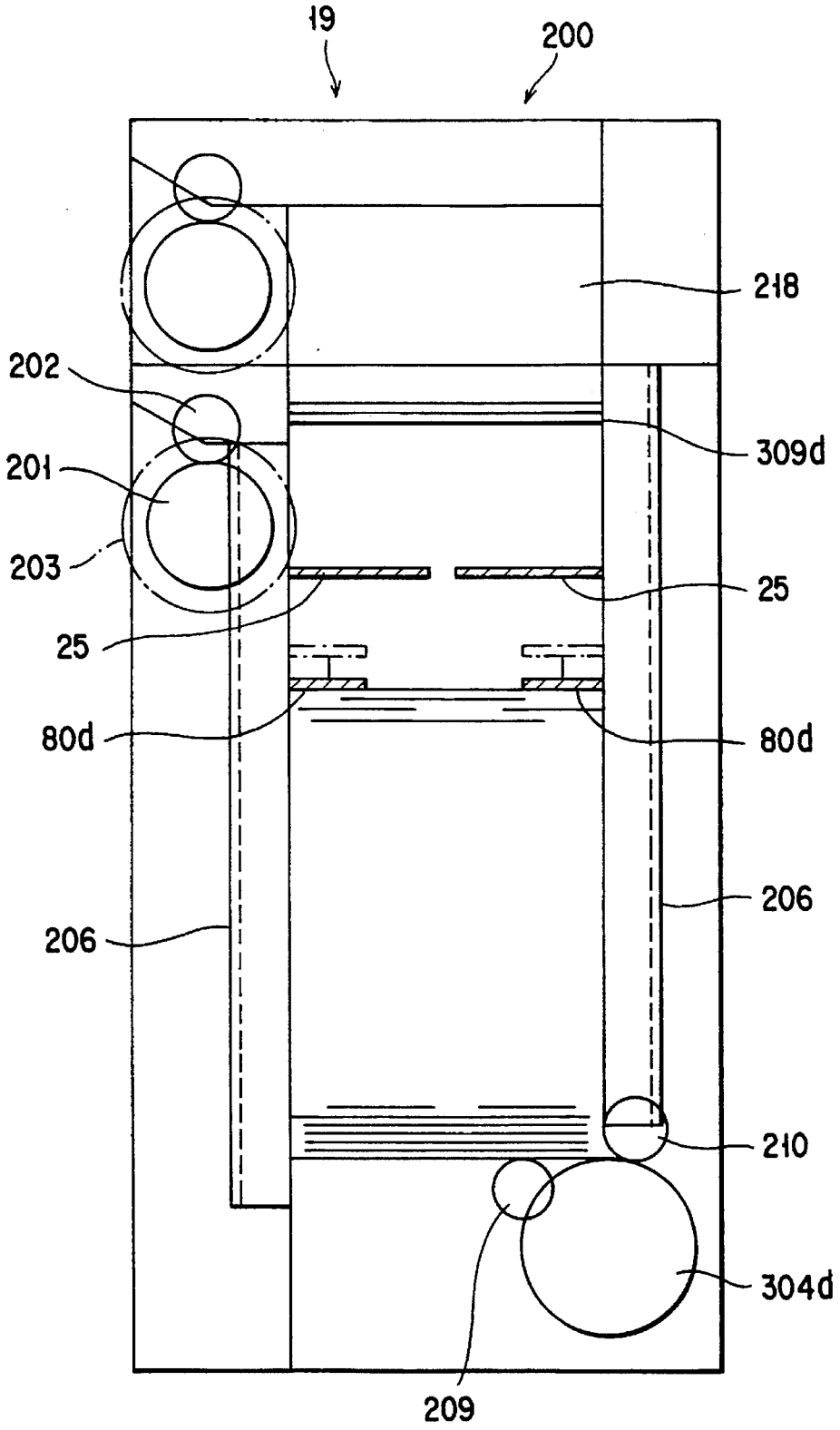
Figure 10:
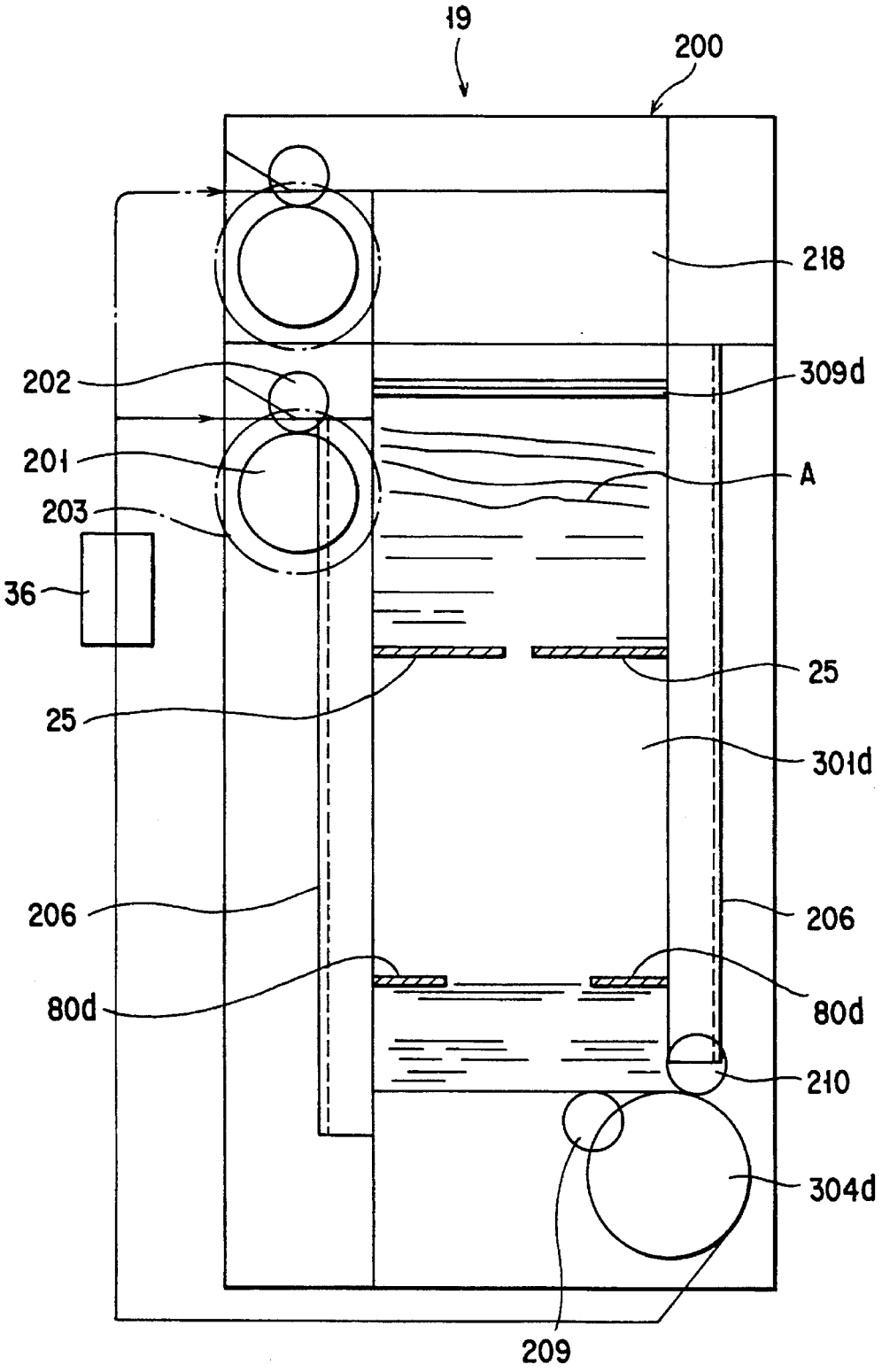

When the shutters 25 and the press plate 80*d* are lifted to the highest position, and set back to the original state, the press plates 80*d* are descended to press banknotes from above, as shown in FIG. 9.

In order to count the number of banknotes stacked in the safe 19, banknotes A are taken out one by one from the bottom of the main body 200 and sent to the inspecting section 36 via the take-out roller 304*d*, feed roller 209 and the gate roller 210. In the inspecting section 36, the denominations of the banknotes are identified and the number thereof is counted, then the banknotes A are once again sent in the stacking section 301*d* and stacked on the shutter 25. Those of the banknotes A which are not identifiable are stored in the reject safe 218 provided on the stacking section 301*d* in the main body 200.

Upon taking out banknotes A one by one from the bottom of the stacking section 301*d*, they can be taken out stably up to a certain number due to their weight which generates frictional force between the feed roller 304*d* and the banknotes. However, if the number of banknotes falls below a certain quota, the stable output of banknotes cannot be sustained. More specifically, as shown in FIG. 5, the press plates 80*d* are small as compared to the shutters 25, and are arranged away from each other. Therefore, the upper surface of the stacked banknotes A can be pressed only partially, making it difficult to achieve a stable output of banknotes at all times.

Figure 11:
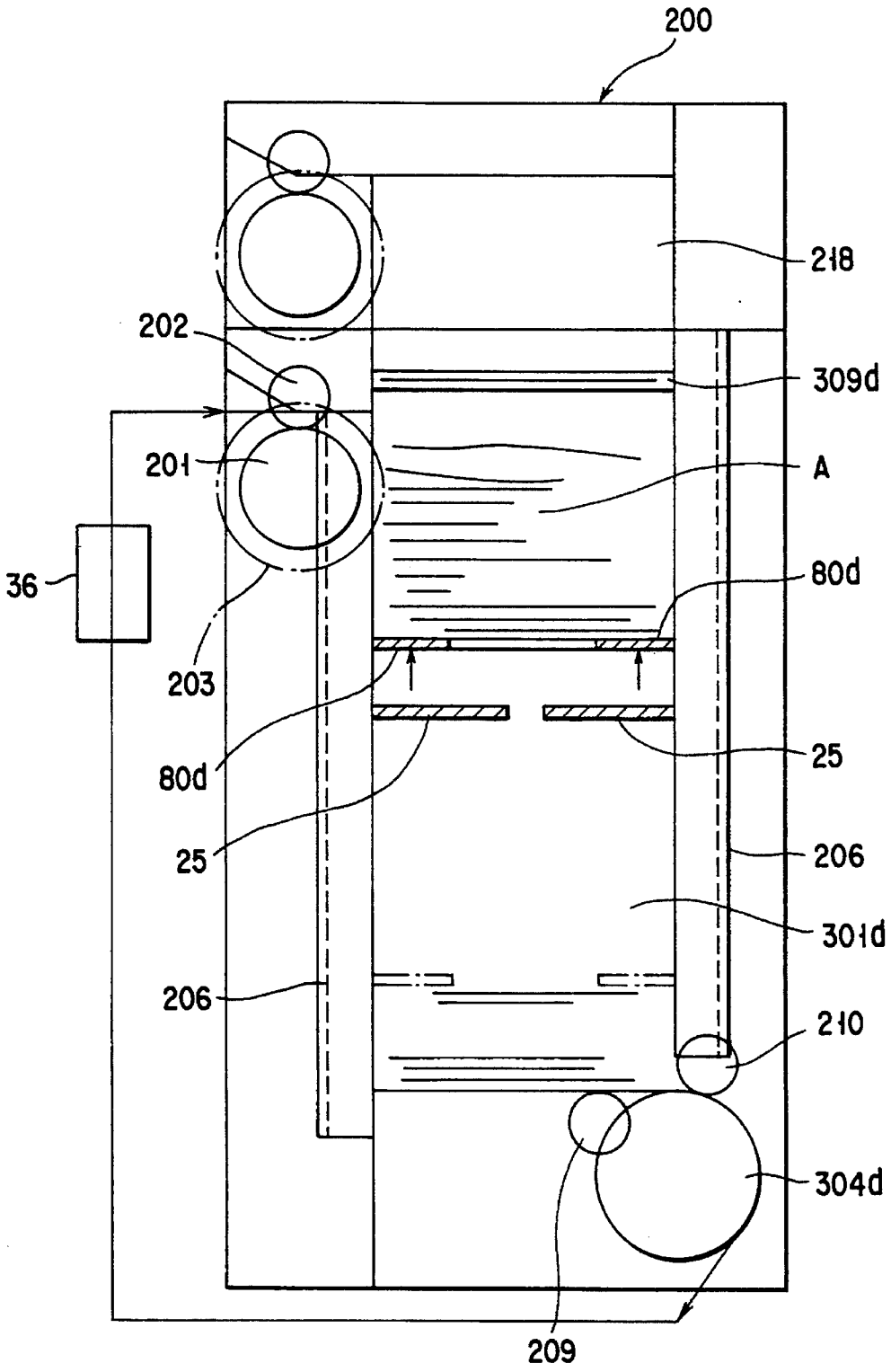
Figure 12:
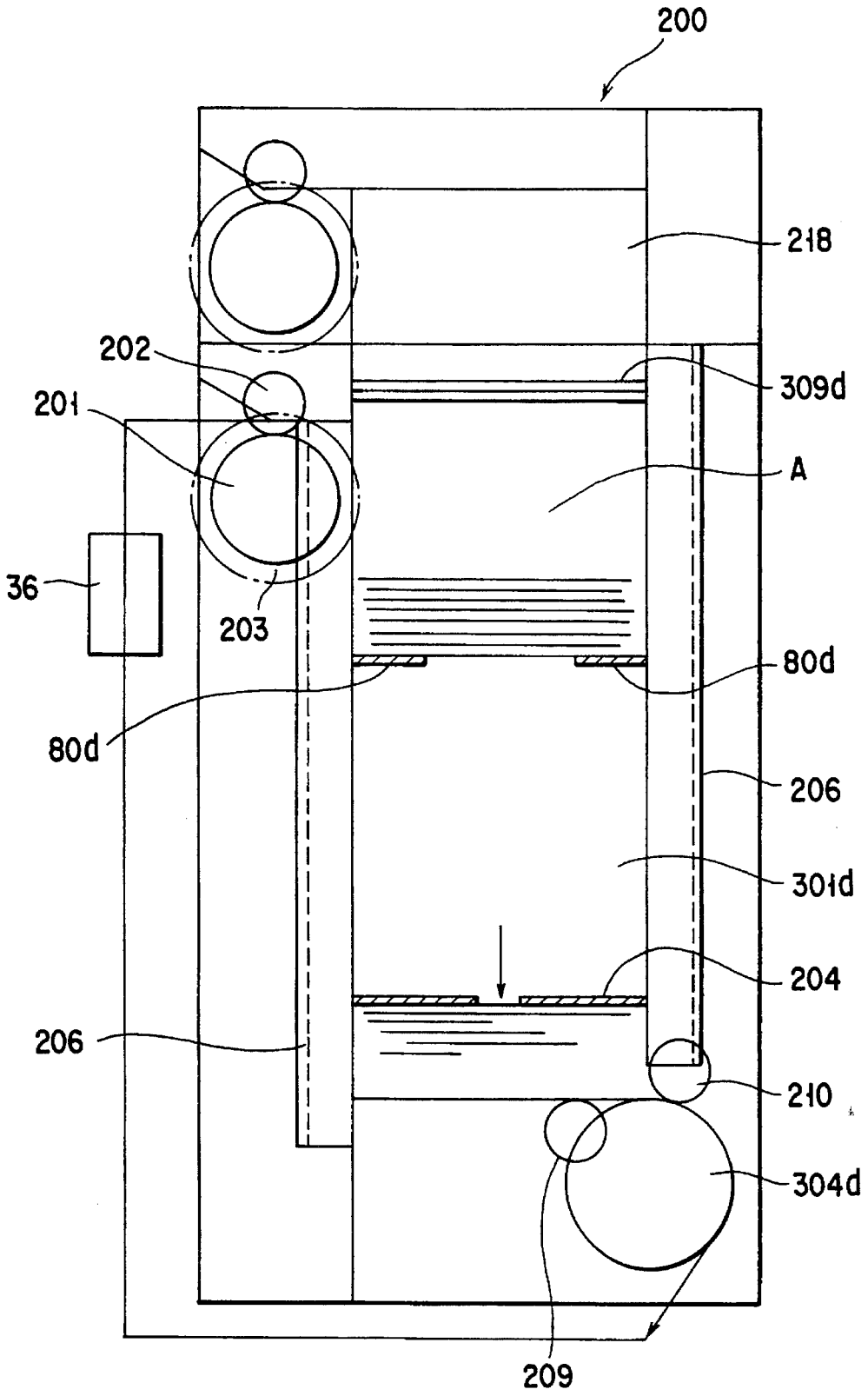
Figure 13:
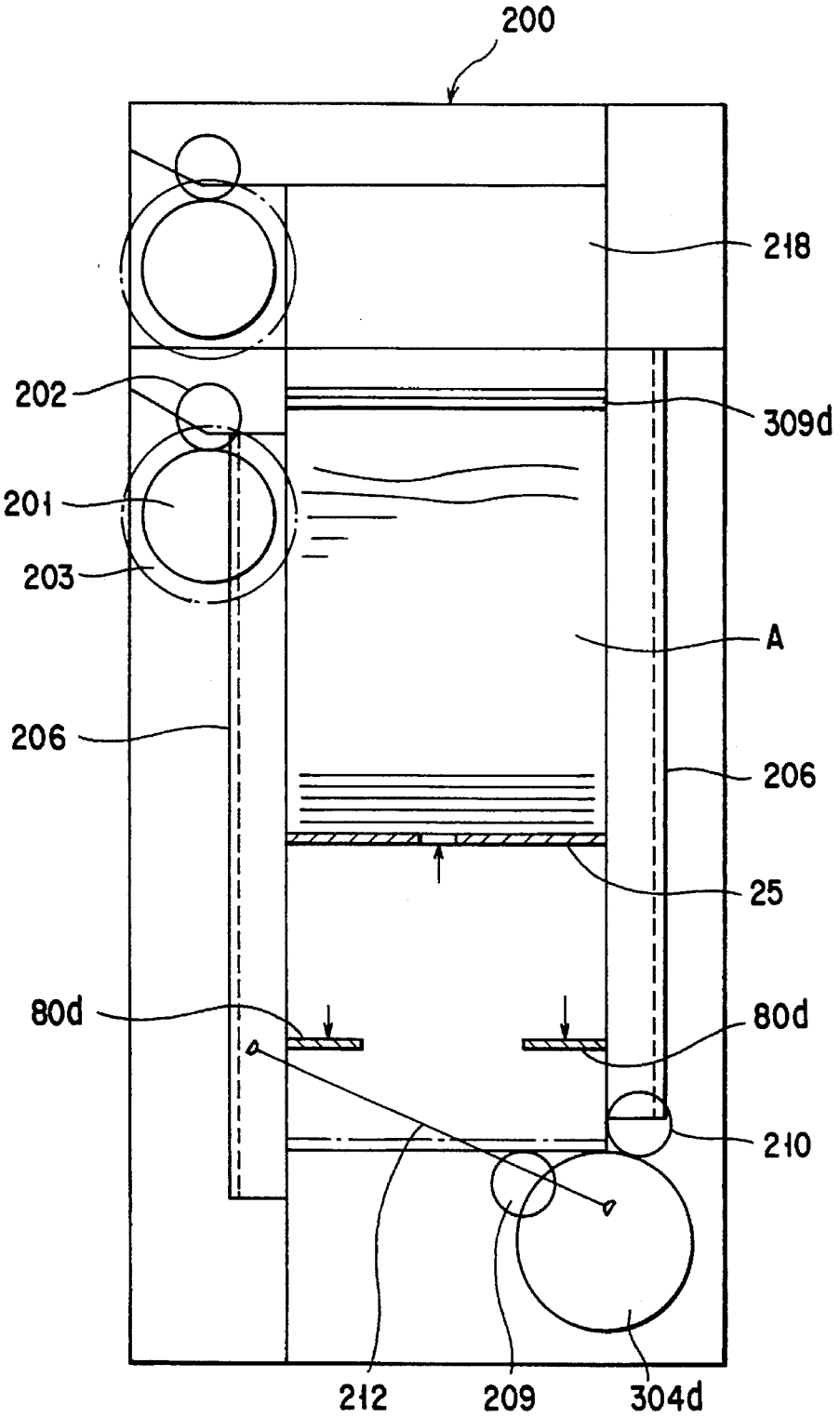

In order to avoid this problem, the present embodiment includes the following structure. That is, when the number of stacked banknotes A reduces to a predetermined quota, or the top surface of the stacked banknotes descends to a certain level, the press plates 80*d* are lifted above the shutters 25, and the banknotes A stacked on the shutters 25 which have been already counted are supported by the press plates as shown in FIG. 11. Then, as shown in FIG. 12, the shutters 25 are descended to press the top surface of the uncounted banknotes A which remains in the bottom of the stacking section 301*d*. Thus, the uncounted banknotes A are pressed against the feed roller 304*d*, enabling to continue a stable output of banknotes. Further, the structure of the mechanism can be simplified. A banknote take-out operation is completed by confirming that there is no more banknotes in the bottom of the storing section by a sensor 212 for detecting remaining banknotes, provided in the lower portion of the main body 200.

Thereafter, the shutters 25 are lifted to support counted banknotes A, and the press plates 80*d* are moved underneath the shutters, thus completing the counting operation.

Next, the detecting method for detecting a banknote-full or empty state of the safe 19 having the above structure will be described.

Figure 14:
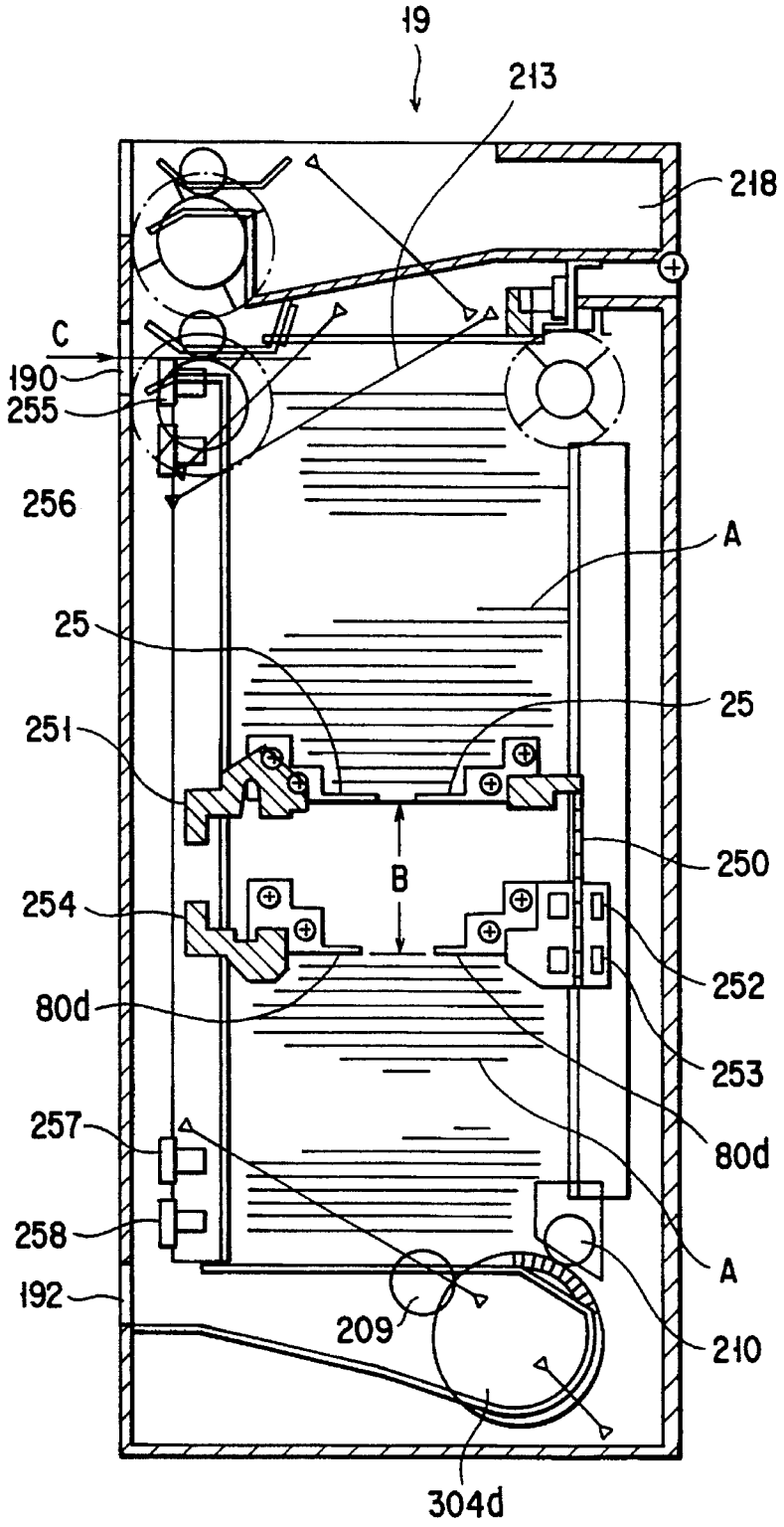
Figure 15:
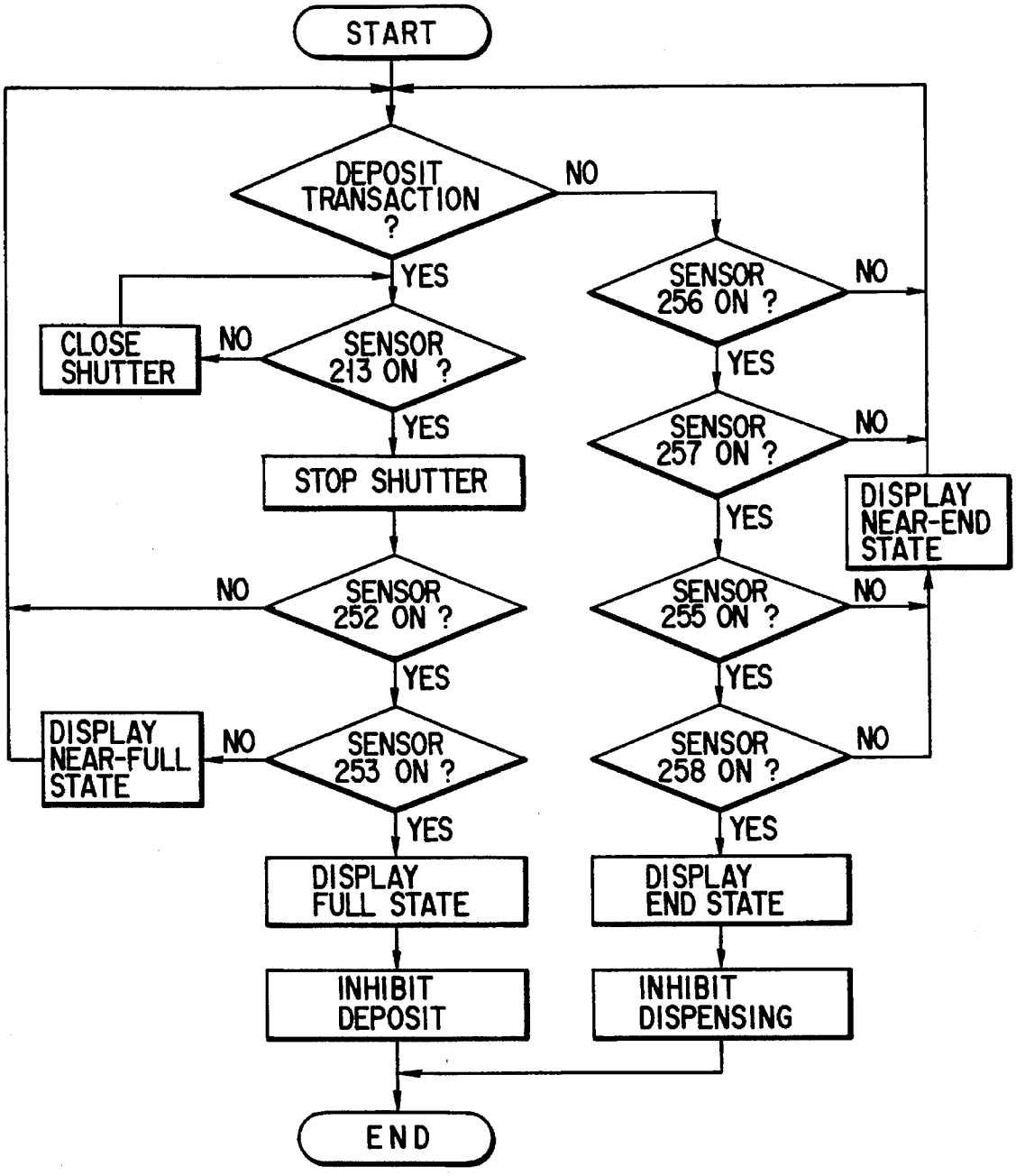

In a deposit operation, as shown in FIGS. 14 and 15, banknotes A conveyed successively from the conveying path of the deposit/withdrawal apparatus 12 are successively stacked on the shutters 25 in the stacking section 301*d* by the cone roller 201 and the pinch roller 202. When the top one of the banknotes A stacked on the shutters 25 is detected by a stack sensor 213, the shutters 25 are descended by the ascending/descending mechanism 350 to assure a space for receiving banknotes. When the end sensors 255 and 256 detect that the shutters 25 are located at the highest position, the controller 10 determines that there is not sufficient space for receiving banknotes in the stacking section 301*d*. Therefore, the controller 10 drives the ascending/descending mechanism 350 to descend the shutters 25 to define a space for receiving banknotes, thus enabling a stable stacking of banknotes.

Each time one deposit operation is completed, banknotes A stacked on the shutters 25 are transferred to the bottom of the stacking section 301*d*, and pressed by the press plates 80*d* from above. As the above-described deposit process is repeated, the shutters 25 are gradually lowered, whereas the press plates 80*d* are gradually lifted. Thus, the shutters 25 and the press plates 80*d* gradually approach each other. When a distance B between the shutters 25 and the press plates 80*d* reaches a predetermined measurement or less, the shield plate 251 of the shutter 25 is detected by the full detection sensors 252 and 253 provided on the press plate 80*d*. The detection data is sent to the controller 10, and the controller 10 determines that the main body 200 is in full state with banknotes A.

Figure 16:
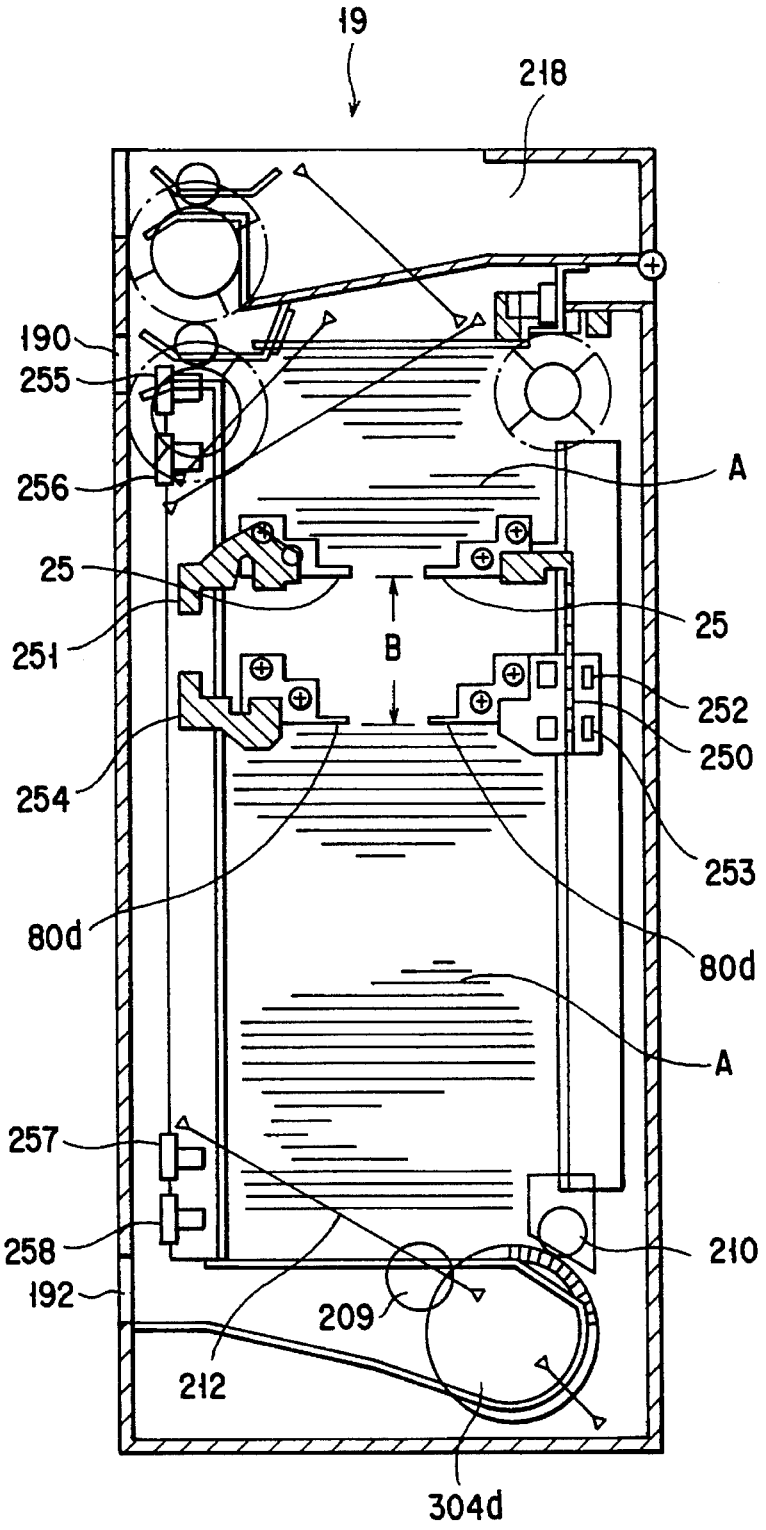

Each of FIGS. 14 and 16 shows banknote-full states, with FIG. 14 showing a case where there are more banknotes A on the shutters 25 than those underneath the press plates 80*d*, and FIG. 16 showing a case where there are less banknotes A on the shutters 25 than those underneath the press plates 80*d*. With the above-described structure, the full state of the safe 19 can be detected, regardless of the ratio between the banknotes A on the shutters 25 and those underneath the press plates 80*d*, if the number of banknotes A on the shutters 25 and the number of those underneath the press plates 80*d* total to be a predetermined quota, in other words, the distance between the shutters 25 and the press plates 80*d* is a predetermined length or less.

In this embodiment, the full-state detecting sensors 252 and 253 are arranged at a predetermined distance away from each other in the moving direction of the shutters 25 and the press plates 80*d*. When the shield plate 250 on the shutter 25 is moved to a position which faces the sensor 252 only, and the only the sensor 252 is turned on, the controller 10 detects the safe 19 to be in a near-full state, that is, a state in which the safe 19 will be full by one more deposit. Then, the controller 10 displays a message of the safe being in the near-full state on the display 8 of the teller machine. Further, when both the sensors 252 and 253 are turned on by the shield plate 250 of the shutter 25, the controller 10 detects the safe 19 as being full, and the message of the full state is displayed on the display 8 and the inhibits the further deposit.

In the full state, the distance B between the shutters 25 and the press plates 80*d* is kept to a value with which there is obtained a space just enough for the shutters 25 and the press plates 80*d* to swing when banknotes A on the shutters 25 are transferred underneath the press plates 80*d*.

Figure 17:
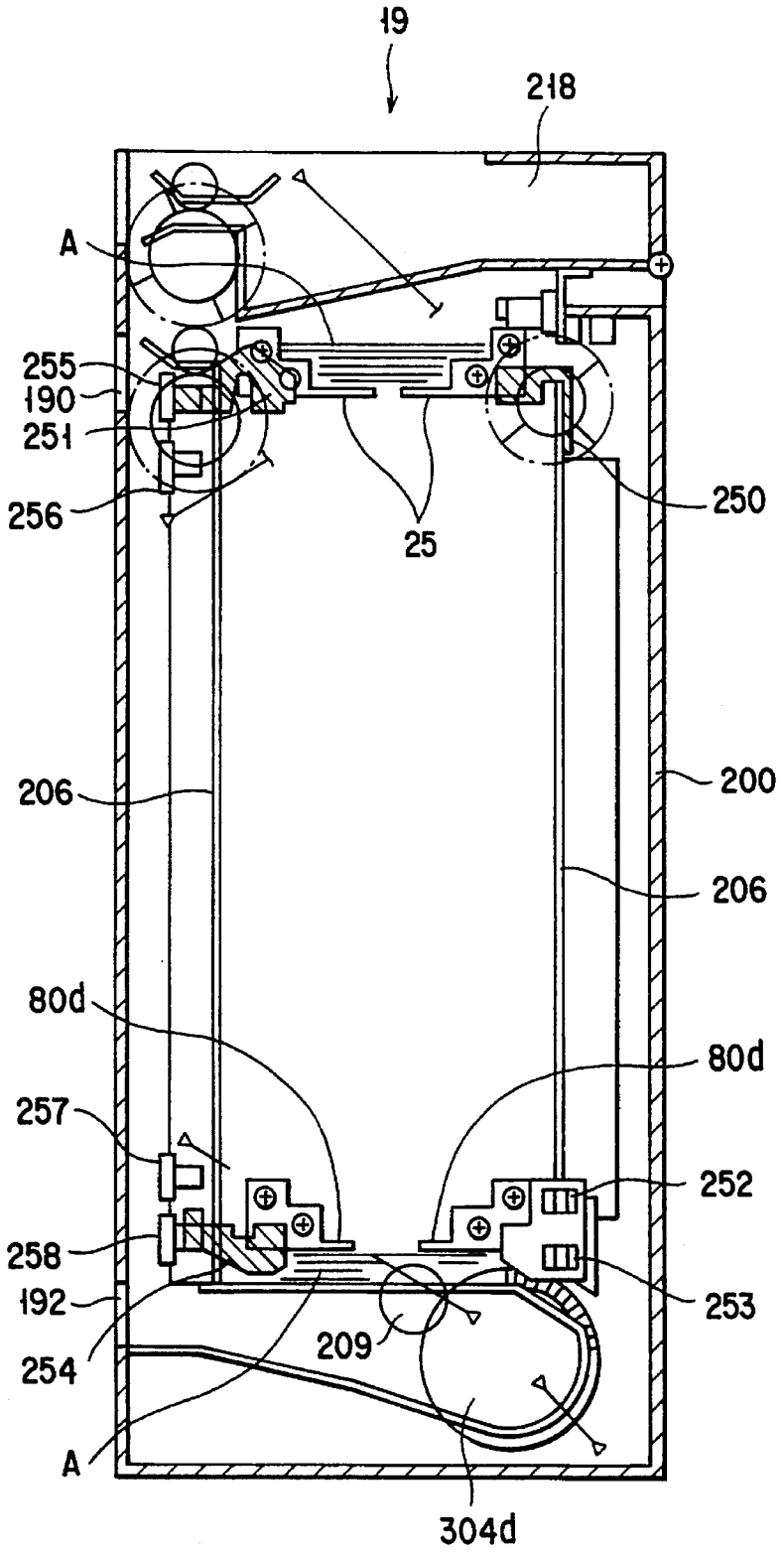

In a dispensing operation, the shutters 25 are in advance moved to the upper end position, and the press plates 80*d* is gradually lowered as banknotes A are taken out one by one from the bottom of the safe 19, as shown in FIG. 17. Then, when the shield plate 251 of the shutter 25 is detected by the end-detecting sensor 256, and the shield plate 254 of the press plate 80*d* is detected by the end-detecting sensor 257, such data are sent to the controller 10. Thus, the controller 10 determines the safe 19 as being in a near-end state, that is a state in which the safe 19 contains only banknotes whose number is equal to or somewhat larger than a maximum number which the receiving/dispensing apparatus can dispense at one time, and displays such a message.

Meanwhile, when the shield plate 251 of the shutter 25 is detected by the end-detecting sensor 255, and the shield plate 254 of the press plate 80*d* is detected by the end-detecting sensor 258, the controller 10 detects that the sum of the number of banknotes A on the shutters 25 and those underneath the press plates 80*d* is less than the maximum number mentioned above. Thus, an empty state of the safe 19 is detected. The controller 10 displays a message of the safe 19 being in an empty state, on the display 8, and inhibits a further dispensing operation from the safe 19.

According to the receiving/dispensing apparatus having the above-described structure, not only the banknote-full state but also the empty state of each of the safes 16 to 18 and the safe 19 can be detected even through the apparatus is of the first-in first-out type. Therefore, when the receiving/dispensing apparatus is applied to an automatic teller machine, the teller machine can achieve a variety of operations in practice. More specifically, with being able to detect the full, near-full, end, or near-end state, the type of the transaction of the apparatus can be limited or inhibited in accordance with the state. For example, upon detection of the full state, no further deposit operations can be inhibited, or upon detection of the end state, no further dispensing operations can be inhibited.

Lastly, the present invention is not limited to the above-described embodiment, and can be modified into various versions within the scope of the invention. For example, in the embodiment, the shielding plate 250 is provided on the shutter 25, and the sensors 252 and 253 are provided on the press plates 80*d*, but it is also possible that, reversely, the sensors and the to-be-detected portion can be provided on the shutter and the press plates, respectively.

What is claimed is:

1. A paper sheet storing apparatus comprising:

a main body including a stacking section for storing paper sheets in a stack in a predetermined direction, the main body having a paper sheet inlet port arranged at a first end portion of the main body, and a paper sheet outlet port arranged at a second end portion of the main body;

conveying means provided at the main body, for taking paper sheets into the stacking section through the inlet port;

receiving means arranged in the stacking section to be movable in the predetermined direction, for receiving and supporting the paper sheets taken into the stacking section through the inlet port, in a stack;

drive means for moving the receiving means toward the second end portion as the paper sheets are stacked, and for transferring the paper sheets on the receiving means to the second end portion after stacking;

take-out means for taking out the paper sheets stacked in the second end portion through the outlet port;

pressing means arranged in the stacking section to be movable in the predetermined direction, for pressing the paper sheets stacked in the second end portion against the take-out means;

detecting means for detecting an approach state when the receiving means and the pressing means approach each other by a predetermined distance; and determining means for determining that the stacking section is in a full state with the paper sheets when the detecting means detects the approach state.

2. An apparatus according to claim 1, wherein said detecting means includes a detected portion 10 provided on one of the receiving means and the pressing means, and a sensor provided on the other of the receiving means and the pressing means, for detecting the detected portion when the receiving means and the pressing means approach by said predetermined distance.

3. An apparatus according to claim 2, wherein said sensor includes a first sensor for detecting the detected portion when the receiving means and the pressing means approach by said predetermined distance, and a second sensor for detecting the detected portion when the receiving means and the pressing means approach by a second predetermined distance which is longer than said predetermined distance.

4. An apparatus according to claim 1, wherein said receiving means includes a shutter movable between a support position wherein the shutter projects into the stacking section to supporting paper sheets, and a retreated position wherein the shutter is retreated from the stacking section so as to transfer the paper sheets stacked on the shutter to the second end portion, and said drive means includes a first driving mechanism for moving the shutter in said predetermined direction, and a second driving mechanism for moving the shutter between the support position and the retreated position.

5. An apparatus according to claim 1, further comprising:

first end detecting means for detecting the receiving means when the receiving means is moved to a first end position close to the first end portion; and second end detecting means for detecting the pressing means when the pressing means is moved to a second end position close to the second end portion;

wherein said determining means includes means for detecting the stacking section to be in an empty state when the first and second end detection means detect the receiving means and the pressing means at the same time.

6. A paper sheet storing apparatus comprising:

a main body including a stacking section for storing paper sheets in a stack in a predetermined direction, the main body having a paper sheet inlet port arranged at a first end portion of the main body, and a paper sheet outlet port arranged at a second end portion of the main body;

conveying means provided at the main body, for taking paper sheets into the stacking section through the inlet port;

receiving means arranged in the stacking section to be movable in the predetermined direction, for receiving and supporting the paper sheets taken into the stacking section through the inlet port, in a stack;

drive means for moving the receiving means toward the second end portion as the paper sheets are stacked, and for transferring the paper sheets on the receiving means to the second end portion after stacking;

take-out means for taking out the paper sheets stacked in the second end portion through the outlet port;

pressing means arranged in the stacking section to be movable in the predetermined direction, for pressing the paper sheets stacked in the second end portion against the take-out means;

first detecting means for detecting the receiving means when the receiving means is moved to a first end position close to the first end portion;

second detecting means for detecting the pressing means when the pressing means is moved to a second end position close to the second end portion; and determining means for determining the stacking section to be in an empty state when the first and second detection means detect the receiving means and the pressing means at the same time.

7. An apparatus according to claim 6, wherein said first detecting means includes a first end detecting means for detecting the receiving means when the receiving means is moved to the first end position, and a first near-end sensor for detecting the receiving means when the receiving means is moved to a first near-end position located on the second end portion 10 side by a predetermined distance from the first end position, the second detecting means includes a second end sensor for detecting the pressing means when the pressing means is moved to the second end position, and a second near-end sensor for detecting the pressing means when the pressing means is moved to a second near-end position located on the first end portion side by a predetermined distance from the second end position, and the determining means includes means for detecting the stacking section to be in a state just before the empty state when the first and second near-end sensors detect the receiving means and the pressing means at the same time.

* * * * *